US007503774B2

(12) United States Patent
Yumi et al.

(10) Patent No.: US 7,503,774 B2
(45) Date of Patent: Mar. 17, 2009

(54) SURFACE MOUNT CONTACT MEMBER

(75) Inventors: Hideo Yumi, Aichi-ken (JP); Kenji Konda, Aichi-ken (JP)

(73) Assignee: Kitagawa Industries Co., Ltd (JP)

( * ) Notice: Subject to any disclaimer, the term of this patent is extended or adjusted under 35 U.S.C. 154(b) by 0 days.

(21) Appl. No.: 12/167,410

(22) Filed: Jul. 3, 2008

(65) Prior Publication Data

US 2009/0011662 A1 Jan. 8, 2009

Related U.S. Application Data

(60) Provisional application No. 60/950,623, filed on Jul. 19, 2007.

(30) Foreign Application Priority Data

Jul. 6, 2007 (JP) ..... 2007-178605
Mar. 26, 2008 (JP) ..... 2008-080792

(51) Int. Cl.
*H01R 12/00* (2006.01)

(52) U.S. Cl. ..... 439/81; 439/940

(58) Field of Classification Search ..... 439/81, 439/95, 940; 174/261
See application file for complete search history.

(56) References Cited

U.S. PATENT DOCUMENTS 5,189,638 A * 2/1993 Kimura ..... 365/52
5,671,123 A * 9/1997 Omori et al. ..... 361/737
6,533,097 B1 * 3/2003 Sakamoto et al. ..... 194/206
2004/0127106 A1 7/2004 Sekiguchi
2005/0023119 A1 2/2005 Lu

FOREIGN PATENT DOCUMENTS

EP 1 026 787 A3 8/2000
GB 2 392 322 7/2005
JP 2002 170617 6/2002

* cited by examiner

*Primary Examiner*—Phuong K Dinh
(74) *Attorney, Agent, or Firm*—Davis & Bujold, P.L.L.C.

(57) ABSTRACT

A surface mount contact member includes a metal base and a conductive coil spring. The metal base is provided with a nozzle suction surface to be sucked by a suction nozzle and a soldering surface that can be soldered. The soldering surface is faced downward when the nozzle suction surface is faced upward. The conductive coil spring is attached to the metal base in an electrically conductive manner with the nozzle suction surface being exposed to an inner peripheral side of the coil spring.

3 Claims, 8 Drawing Sheets

SURFACE MOUNT CONTACT MEMBER

CROSS-REFERENCE TO RELATED APPLICATIONS

This application claims the benefit of Japanese Patent Application No. 2007-178605 filed Jul. 6, 2007, which corresponds to U.S. Provisional Patent Application No. 60/950,623 filed Jul. 19, 2007, and Japanese Patent Application No. 2008-080792 filed Mar. 26, 2008, the disclosures of which are incorporated herein by reference.

TECHNICAL FIELD

This invention belongs to a technical field of a surface mount contact member to be mounted on a surface of a printed circuit board in order to achieve conduction between the printed circuit board and, for example, a housing.

BACKGROUND

In order to achieve conduction between a printed circuit board and, for example, a housing, a surface mount contact member to be mounted on a surface of the printed circuit board includes a coil spring connector provided with two coil springs and an insulating holder that holds the two coil springs apart, as disclosed in Unexamined Japanese Patent Publication No. 2002-170617. A flat surface formed on the holder between the two coil springs is used as a nozzle suction surface to be sucked by a suction nozzle.

SUMMARY

In the case of the above coil spring connector, the flat surface between the two coil springs can be sucked by the suction nozzle for automatic mounting. However, since the coil spring connector is constituted of two (or more) coil springs and the insulating holder, a constitution with only a single coil spring, that is, reduction in number of components, has been desired.

A surface mount contact member in a first aspect of the present invention includes: a metal base provided with a nozzle suction surface to be sucked by a suction nozzle and a soldering surface that can be soldered and is faced downward when the nozzle suction surface is faced upward; and a conductive coil spring attached to the metal base in an electrically conductive manner with the nozzle suction surface being exposed to an inner peripheral side of the coil spring.

The surface mount contact member of the first aspect is mounted on a surface of the printed circuit board with its soldering surface soldered on the printed circuit board. Soldering is not limited only to the soldering surface. For example, not only the soldering surface but the side surface and so on of the metal base may be soldered.

The metal base is provided with the nozzle suction surface to be sucked by the suction nozzle, other than the soldering surface. The soldering surface is faced downward when the nozzle suction surface is faced upward. The coil spring is attached to the metal base in an electrically conductive manner with the nozzle suction surface being exposed to the inner peripheral side of the coil spring. Therefore, automatic mounting of the contact member is achieved by inserting the suction nozzle through the interior of the coil spring and sucking the nozzle suction surface by the suction nozzle.

The conductive coil spring, which is attached to the metal base in an electrically conductive manner, functions as a contact point, and is brought into pressurized contact with a different conducting body (for example, a housing or other printed circuit board) from the printed circuit board having the surface mount contact member soldered thereon.

Since the contact point is made of a coil spring, no plastic deformation but mere elastic deformation occurs even if the contact point is touched by a worker or other members. Also, the contact point made of a coil spring is unlikely to be damaged due to loss of spring elasticity even if repetitively used multiple times.

In a second aspect of the present invention, the nozzle suction surface is a top surface of a protrusion provided to stand on a base portion of the metal base. The coil spring is fitted over the protrusion. The soldering surface is provided on a leg portion extending from the base portion in a direction opposite to the protrusion.

The nozzle suction surface is the top surface of the protrusion provided to stand on the base portion. The coil spring is fitted over the protrusion. Therefore, for example, since no labor such as welding is required, operation to attach the coil spring to the metal base is easy.

In a third aspect of the present invention, the coil spring has an opening only sufficient for the suction nozzle to pass through. Accordingly, the surface mount contact member of the third aspect is suitable to be sucked by the suction nozzle.

In a fourth aspect of the present invention, the coil spring is fitted over the protrusion provided on the metal base, and a reverse section is provided at an upper end of the protrusion in order to inhibit the coil spring from coming off. Accordingly, the surface mount contact member of the fourth aspect can reliably inhibit drop off of the coil spring.

BRIEF DESCRIPTION OF THE DRAWINGS

The invention will now be described below, by way of example, with reference to the accompanying drawings, in which.

EXPLANATION OF REFERENCE NUMERALS

Figure 1F:
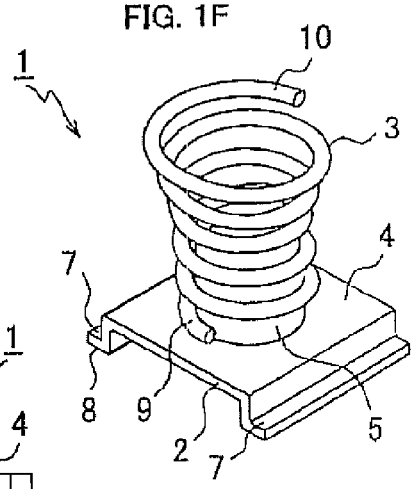
FIGS. 1A, 1B, 1C, 1D, 1E, and 1F are a plan view, a left side view, a front view, a right side view, a bottom view, and a perspective view, respectively, of a surface mount contact member according to a first embodiment.

1, 1*a*, 1*b*, 1*c*, 1*d* . . . surface mount contact member,
2 . . . metal base,
3 . . . coil spring,
4 . . . base portion,
5 . . . protrusion,
6 . . . top surface (nozzle suction surface),
7 . . . leg portion,
8 . . . soldering surface,
9 . . . lower end,

10, 14, 15 . . . upper end,
11 . . . suction nozzle,
12 . . . reverse section,
13 . . . locking portion.

DETAILED DESCRIPTION OF THE PREFERRED EMBODIMENT

First Embodiment

Referring to FIGS. 1A-1F, 2 and 3, a surface mount contact member 1 of the present embodiment includes a metal base 2 and a coil spring 3. The metal base 2 is formed of sheet metal such as brass, phosphor bronze, beryllium copper, and stainless steel. The coil spring 3 is formed of wire such as piano wire, beryllium copper, and stainless steel. Tinning or others may be applied to both the metal base 2 and the coil spring 3.

The metal base 2 is provided with a rectangular base portion 4. A protrusion 5 is provided to stand in a center part of the base portion 4. The protrusion 5 has a cylindrical shape, whose top surface 6 is parallel to the surface of the base portion 4. The top surface 6 is used as a nozzle suction surface.

Leg portions 7 extend from two mutually parallel sides of the base portion 4. The leg portions 7 are formed by bending the base portion 4 at a right angle so as to extend in a direction opposite to a protruding direction of the protrusion 5. The leg portions 7 are further bent at their ends at a right angle. The undersurfaces of the bent ends, which are parallel to the surface of the base portion 4, are used as soldering surfaces 8. That is, the top surface 6 and the soldering surfaces 8 are disposed such that the base portion 4 is located between the top surface 6 and the soldering surfaces 8. The base portion 4 (the surface), the top surface 6, and the soldering surfaces 8 are parallel to one another. As seen from FIG. 2, when the top surface 6 is faced upward, the soldering surfaces 8 are faced downward.

The coil spring 3 is fitted over the protrusion 5 to an extent of 2-3 turns from a lower end 9 of the coil spring 3. That is, the inner diameter of the coil spring 3 is substantially constant to the extent of 2-3 turns from the lower end 9. From the vicinity where the turns of the coil spring 3 are no longer fitted over the protrusion 5 toward an upper end 10 of the coil spring 3, the coil spring 3 has a horn (truncated cone) spiral shape flaring out at the side of the upper end 10.

The above exemplified wire is formed into the coil spring 3 as shown in FIGS. 1A-1F, 2 and 3. The above exemplified sheet metal is pressed into the metal base 2 as shown in FIGS. 1A-1F, 2 and 3. A lower half of the coil spring 3 is then fitted over the protrusion 5 thereby to produce the surface mount contact member 1. In the present embodiment, the surface mount contact member 1 is gilded after the fitting of the coil spring 3 over the protrusion 5 in order to ensure conductivity of the surface of the surface mount contact member 1 and to prevent rust. In a taping step, the surface mount contact member 1 is housed in a recess formed by embossment of an emboss tape (emboss packaged) for shipping.

Figure 1A:
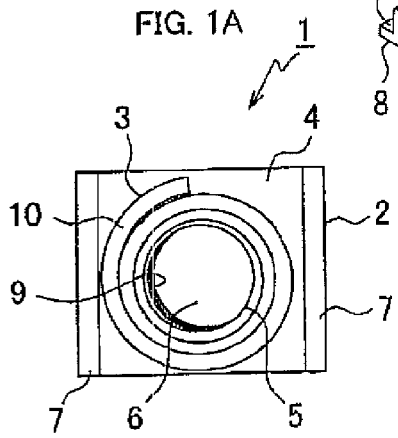
Figure 1B:
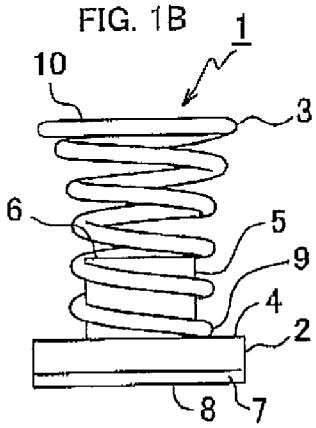
Figure 1C:
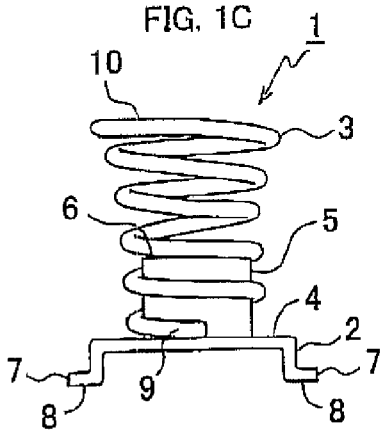
Figure 1D:
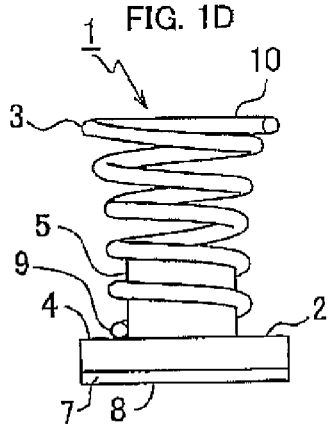
Figure 1E:
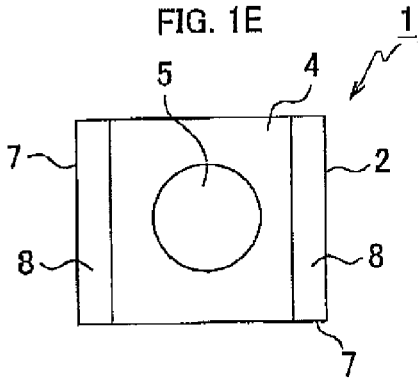
Figure 2:
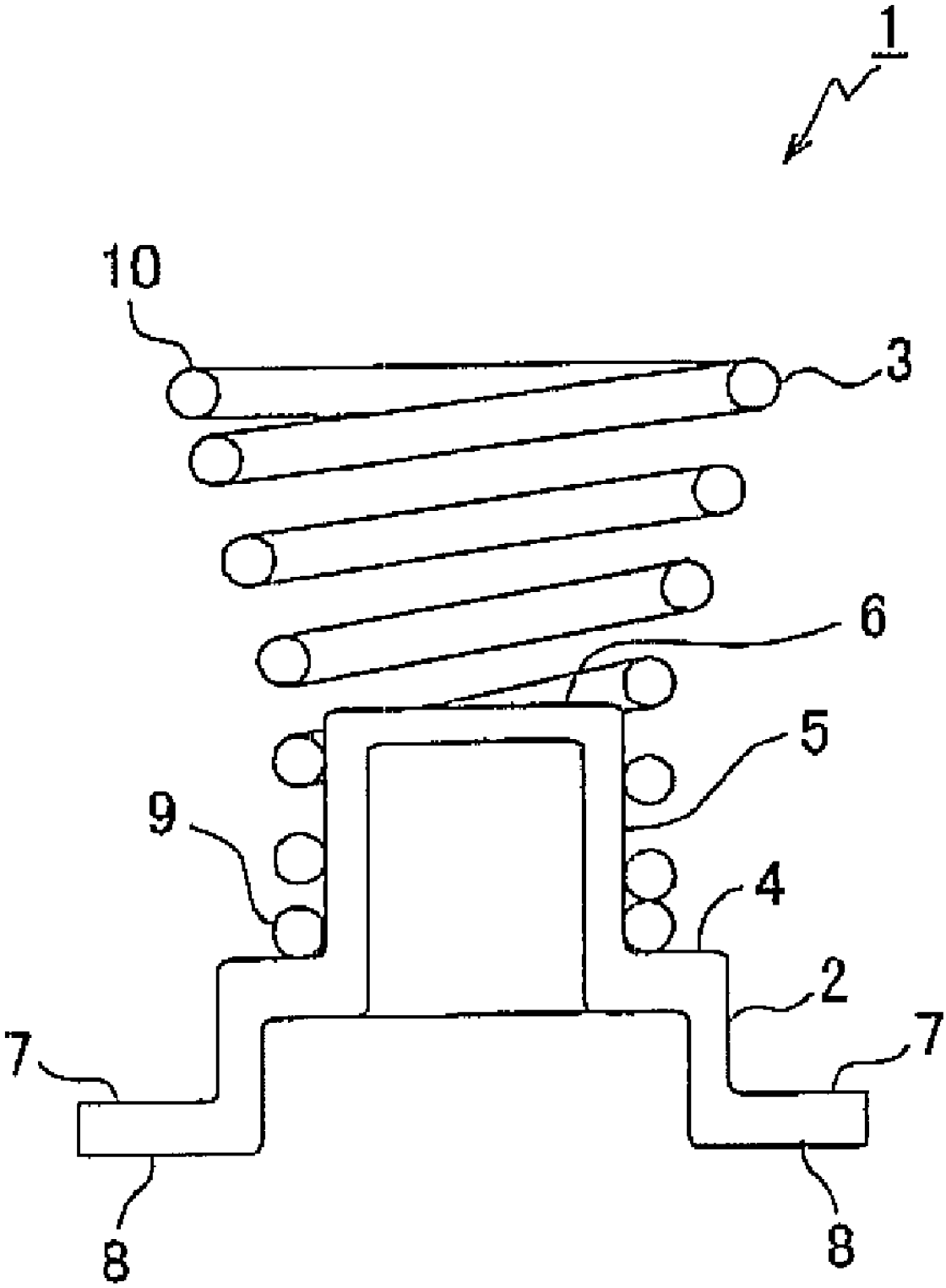
FIG. 2 is a longitudinal sectional view of the surface mount contact member according to the first embodiment.
Figure 3:
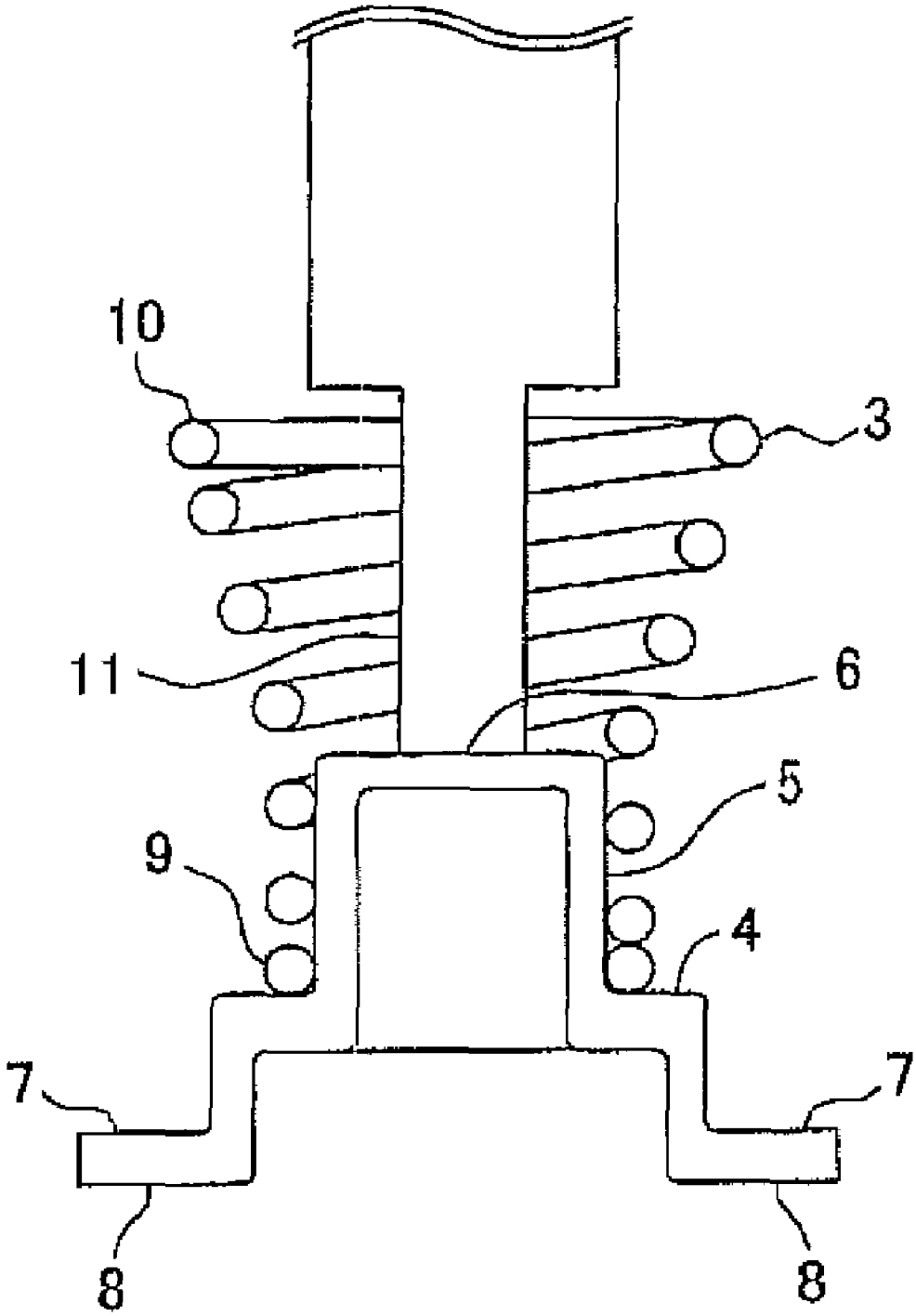
FIG. 3 is a longitudinal sectional view for explaining nozzle suction of the surface mount contact member according to the first embodiment.

The emboss packaged surface mount contact member 1 is provided to an automatic mounting apparatus. As seen in FIGS. 1A and 2, since the coil spring 3 is fitted over the protrusion 5 (the metal base 2) with the top surface 6 of the protrusion 5 exposed to the inner peripheral side of the coil spring 3, a suction nozzle 11 of the automatic mounting apparatus can be inserted through the inner peripheral side of the horn of the coil spring 3 as shown in FIG. 3 to suck the top surface 6 of the protrusion 5.

The surface mount contact member 1 is taken out of the recess formed by embossment by nozzle suction, automatically mounted on a printed circuit board, and then soldered onto the printed circuit board at the soldering surfaces 8 by reflow soldering for surface mounting.

The base portion 4 has a rectangular shape. The coil spring 3 is fitted over the protrusion 5 provided to stand in the center of the base portion 4. A pair of leg portions 7 extend from two mutually parallel sides of the base portion 4. Thus, a suction point (the top surface 6 of the protrusion 5) by the suction nozzle 11 is extremely close to (not far off) the center of gravity of the surface mount contact member 1. Accordingly, the weight balance of the surface mount contact member 1 is favorable upon nozzle suction. The surface mount contact member 1 does not tilt. Therefore, the position of the surface mount contact member 1 mounted on the printed circuit board is accurate.

The coil spring 3 attached to the metal base 2 functions as a contact point and is brought into pressurized contact with a different conducting body (for example, a housing or other printed circuit board) from the printed circuit board having the surface mount contact member 1 soldered thereon. At that time, pressurized contact between the coil spring 3 and the housing or the like is maintained by compression of the coil spring 3.

Since the contact point of the surface mount contact member 1 is made of the coil spring 3, no plastic deformation but mere elastic deformation occurs even if the contact point is touched by a worker or other members. Also, the contact point as the coil spring 3 is unlikely to be damaged due to loss of spring elasticity upon multiple repetition of use.

Second Embodiment

Figure 4:
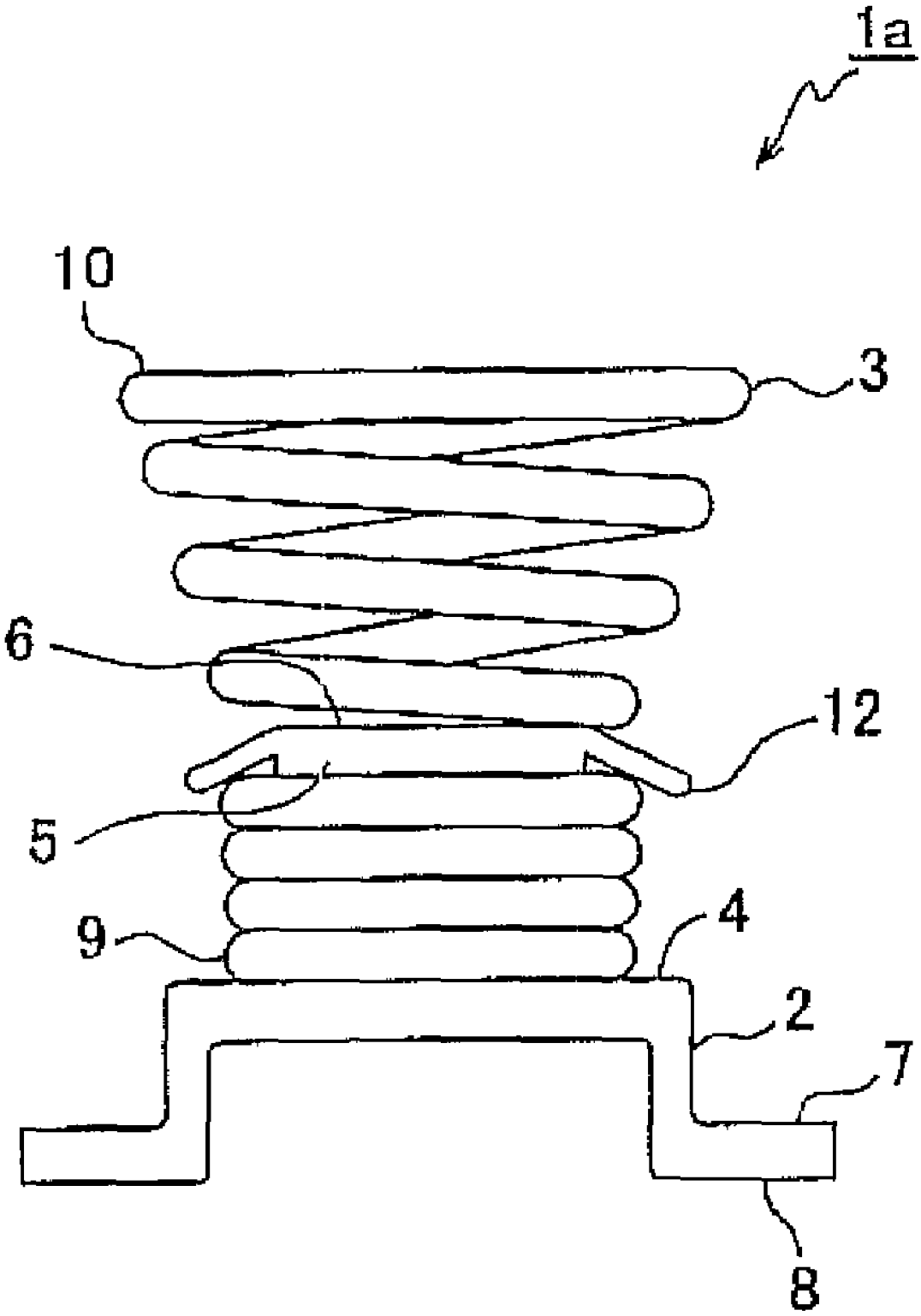
FIG. 4 is a front view of a surface mount contact member according to a second embodiment.
Figure 5:
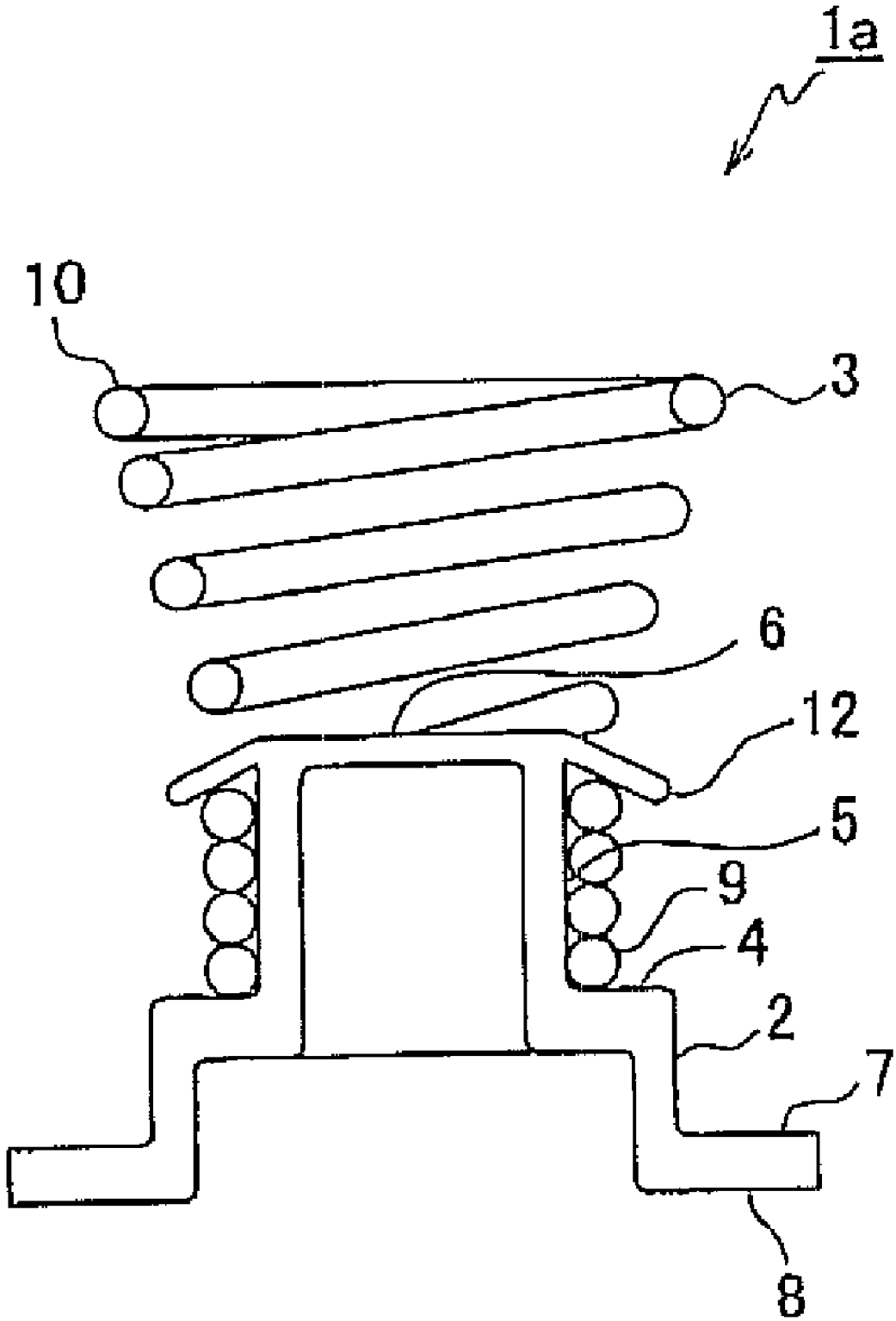
FIG. 5 is a longitudinal sectional view of the surface mount contact member according to the second embodiment.

Referring to FIGS. 4 and 5) a surface mount contact member 1*a* of the present embodiment is provided with reverse sections 12 jutting out obliquely downward from the upper end of the protrusion 5. As is clear from comparison between FIGS. 1A-1F and 2 and FIGS. 4 and 5, the surface mount contact member 1*a* has the same constitution with the surface mount contact member 1 of the first embodiment except for the jutting-out reverse sections 12.

Since the surface mount contact member 1*a* is provided with the reverse sections 12, there is no fear of dropping off of the coil spring 3 from the protrusion 5. The same effects as in the first embodiment can be also achieved.

Third Embodiment

Figure 6:
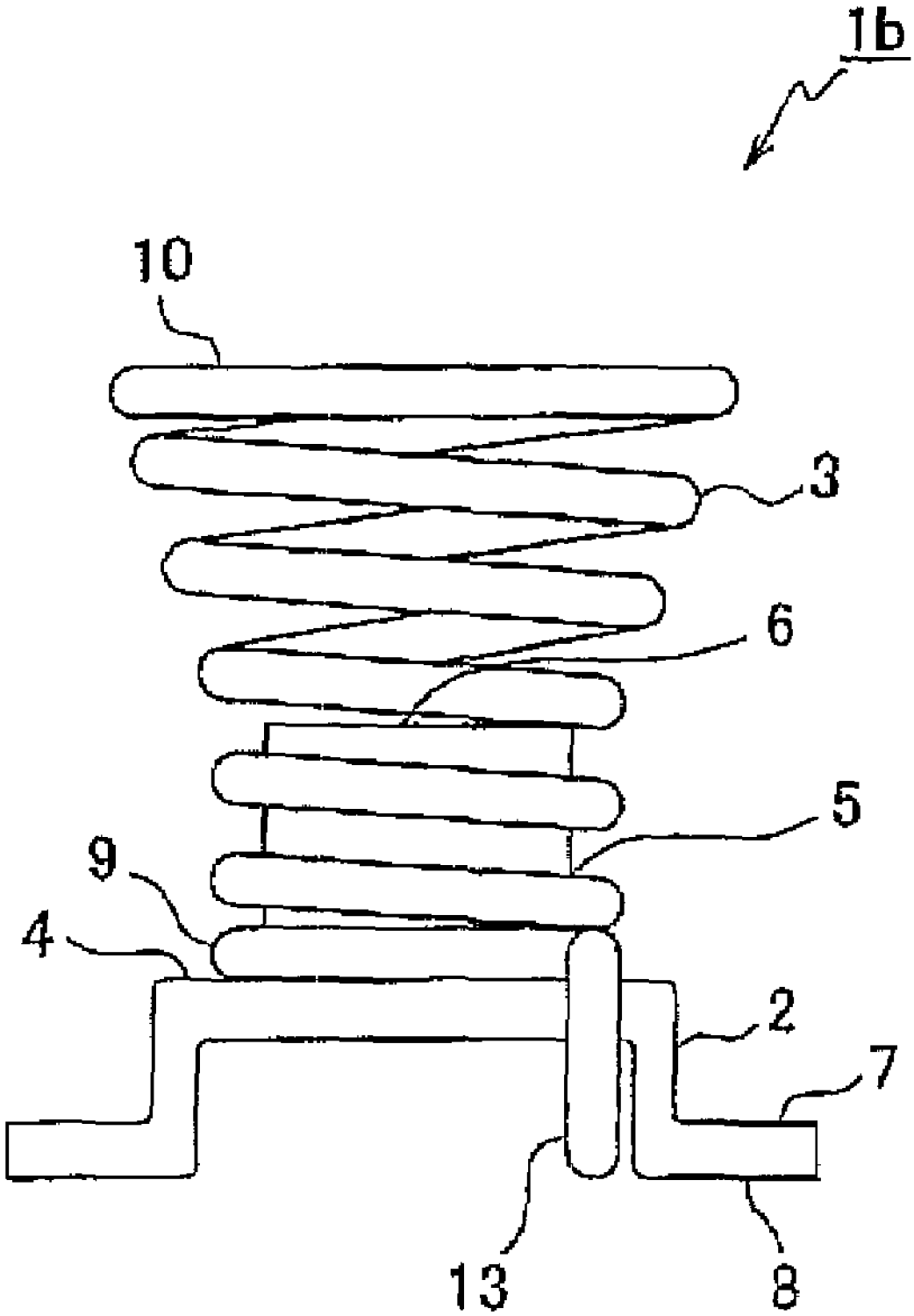
FIG. 6 is a front view of a surface mount contact member according to a third embodiment.

Referring to FIG. 6, a surface mount contact member 1*b* of the present embodiment is provided with a latch portion 13 formed by bending a tip on the side of the lower end 9 of the coil spring 3. The latch portion 13 is caught at an end section of the base portion 4. As is clear from comparison between FIGS. 1A-1F and 6, the surface mount contact member 1*b* has the same constitution with the surface mount contact member 1 of the first embodiment except for the latch portion 13.

In the surface mount contact member 1*b*, since the latch portion 13 provided at the tip of the coil spring 3 is caught at the end section of the base portion 4, relative rotation between the coil spring 3 and the metal base 2 can be inhibited. The same effects as in the first embodiment can be also achieved.

Fourth Embodiment

Figure 7:
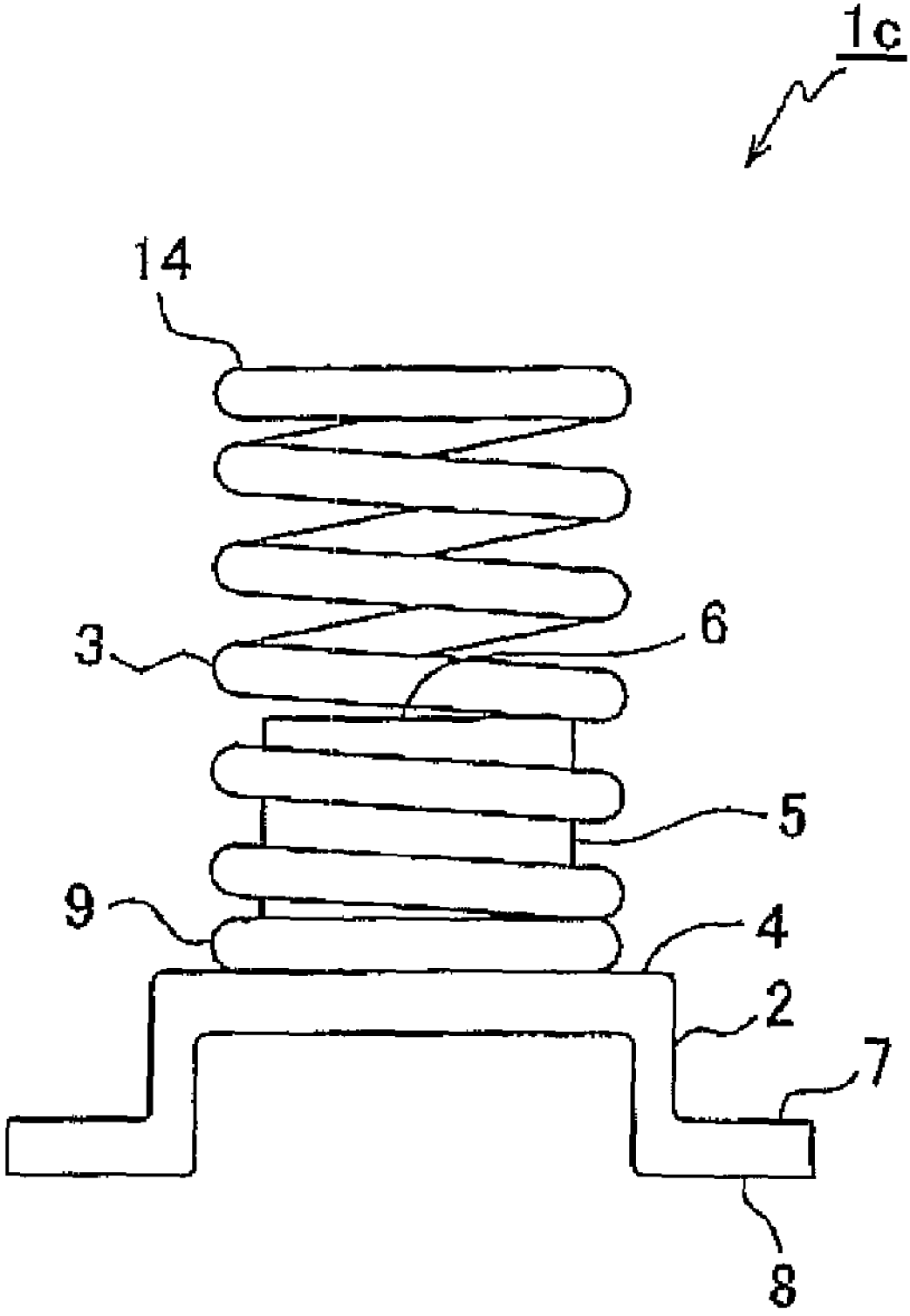
FIG. 7 is a front view of a surface mount contact member according to a fourth embodiment.

Referring to FIG. 7, a surface mount contact member 1*c* of the present embodiment is provided with the coil spring 3 which is not formed into a horn and has the same inner diameter from the lower end 9 through an upper end 14. As is clear from comparison between FIGS. 1A-1F and 7, the surface mount contact member 1*e* has the same constitution with the surface mount contact member 1 of the first embodiment except for absence of variation in diameter of turns of the coil spring 3.

In the surface mount contact member 1*c*, since there is no variation in diameter of turns of the coil spring 3 (diameter of each turn is constant), forming of the coil spring 3 is simplified. Costs for forming can be reduced. The same effects as in the first embodiment can be also achieved.

Fifth Embodiment

Figure 8:
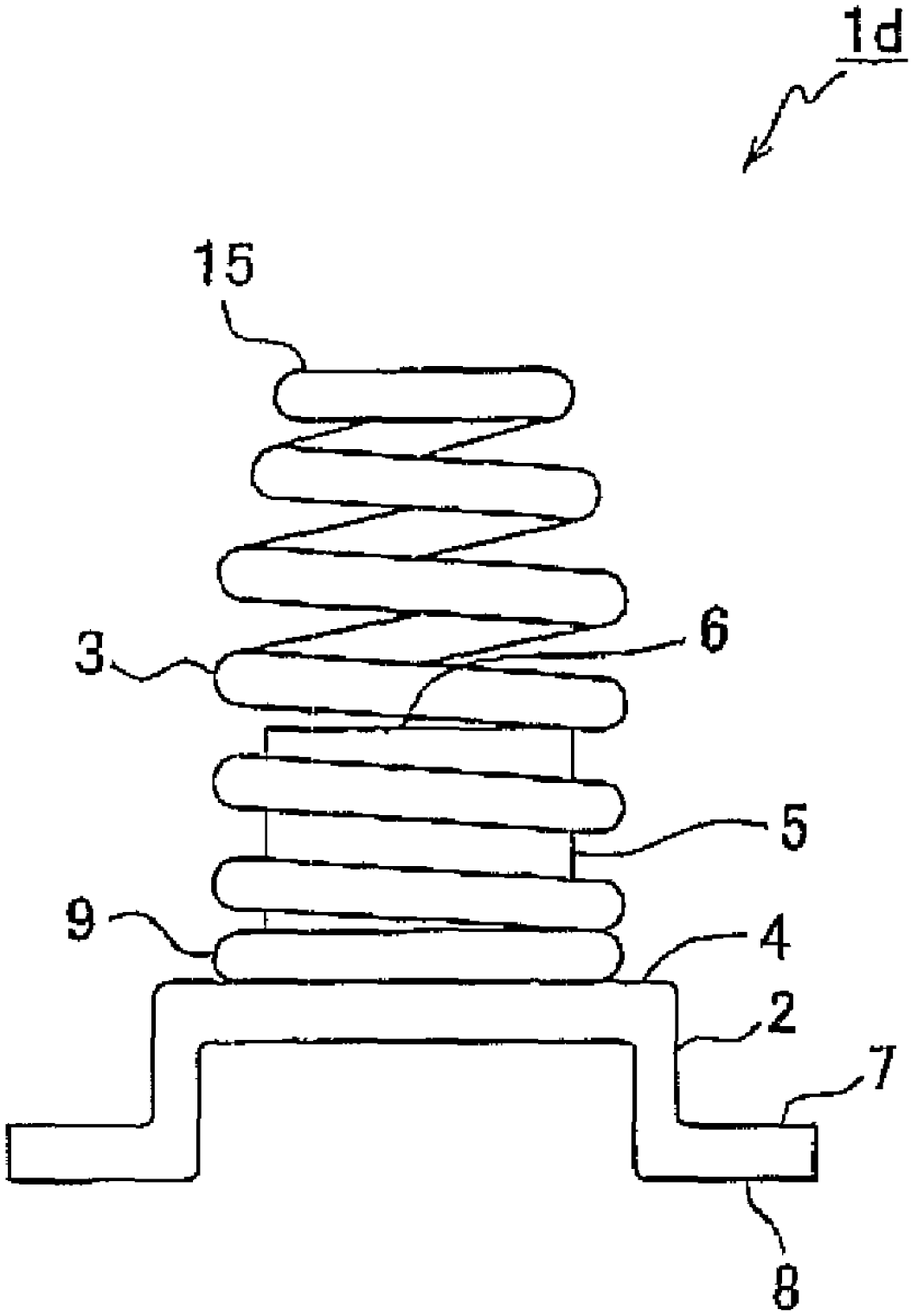
FIG. 8 is a front view of a surface mount contact member according to a fifth embodiment.

Referring to FIG. 8, a surface mount contact member 1*d* is provided with the coil spring 3 having smaller diameters of upper-half turns on the side of an upper end 15. As is clear from comparison between FIGS. 1A-1F and 8, the surface mount contact member 1*d* has the same constitution with the surface mount contact member 1 of the first embodiment except for the spiral form of the coil spring 3.

In the surface mount contact member 1*d*, since the diameters of upper-half turns of the coil spring 3 are gradually reduced toward the side of the upper end 15 so that the coil spring 3 has a shape of a cannonball, application of large force can be avoided even if a worker or the like touches the upper half of the coil spring 3. The same effects as in the first embodiment can be also achieved.

The present invention should not be limited by the above described embodiments. It should be noted that the present invention can be practiced in various manners without departing from the scope of the present invention.

What is claimed is:

1. A surface mount contact member comprising:

a metal base provided with a nozzle suction surface to be sucked by a suction nozzle and a soldering surface that can be soldered and is faced downward when the nozzle suction surface is faced upward; and a conductive coil spring attached to the metal base in an electrically conductive manner with the nozzle suction surface being exposed to an inner peripheral side of the coil spring, wherein the nozzle suction surface is a top surface of a protrusion provided to stand on a base portion of the metal base, the coil spring is fitted over the protrusion, and the soldering surface is provided on a leg portion extending in a direction opposite to the protrusion.

2. The surface mount contact member according to claim 1, wherein the coil spring has an opening only sufficient for the suction nozzle to pass through.

3. The surface mount contact member according to claim 1, wherein the coil spring is fitted over a protrusion provided on the metal base, and a reverse section is provided in an upper end of the protrusion in order to inhibit the coil spring from coming off.

* * * * *